US010260772B2

(12) United States Patent
Mouratidis

(10) Patent No.: US 10,260,772 B2
(45) Date of Patent: Apr. 16, 2019

(54) DUCT MOUNTED SOUND ATTENUATING BAFFLE WITH AN INTERNALLY SUSPENDED MASS LAYER

(71) Applicant: VAW Systems Ltd., Winnipeg (CA)

(72) Inventor: Emanuel Mouratidis, Aurora (CA)

(73) Assignee: VAW Systems Ltd., Winnipeg (CA)

( * ) Notice: Subject to any disclaimer, the term of this patent is extended or adjusted under 35 U.S.C. 154(b) by 77 days.

(21) Appl. No.: 15/433,028

(22) Filed: Feb. 15, 2017

(65) Prior Publication Data

US 2017/0241664 A1 Aug. 24, 2017

Related U.S. Application Data

(60) Provisional application No. 62/299,331, filed on Feb. 24, 2016.

(51) Int. Cl.

| | |
|---|---|
| ***F24F 13/24*** | (2006.01) |
| ***G10K 11/168*** | (2006.01) |
| ***G10K 11/04*** | (2006.01) |
| *F24F 13/00* | (2006.01) |
| *G10K 11/16* | (2006.01) |
| *F24F 13/02* | (2006.01) |

(52) U.S. Cl.
CPC ..... *F24F 13/24* (2013.01); *G10K 11/04* (2013.01); *G10K 11/168* (2013.01); *F24F 13/02* (2013.01); *F24F 2013/242* (2013.01); *G10K 11/161* (2013.01)

(58) Field of Classification Search
CPC ..... F24F 13/24; F24F 13/02; F24F 2013/242; G10K 11/161; G10K 11/168; G10K 11/04; E04F 17/04
See application file for complete search history.

(56) References Cited

U.S. PATENT DOCUMENTS

| | | | | | |
|---|---|---|---|---|---|
| 2,270,825 | A * | 1/1942 | Parkinson | G10K 11/161 | 181/224 |
| 2,855,039 | A * | 10/1958 | Gross | E04B 1/8209 | 160/236 |
| 2,916,101 | A * | 12/1959 | Naman | F16L 55/02754 | 181/224 |
| 3,019,850 | A * | 2/1962 | March | E04B 1/8209 | 181/224 |
| 3,378,100 | A * | 4/1968 | Welty | F24F 13/24 | 181/224 |

(Continued)

FOREIGN PATENT DOCUMENTS

| | | | | |
|---|---|---|---|---|
| EP | 0921358 A2 * | 9/1999 | F24F 13/24 |
| EP | 3002405 A2 * | 4/2016 | E06B 7/02 |

*Primary Examiner* — Edgardo San Martin
(74) *Attorney, Agent, or Firm* — Ryan W. Dupuis; Ade & Company Inc; Kyle R. Satterthwaite

(57) ABSTRACT

A sound attenuating baffle mounts within the duct section of an air distribution HVAC system, a ventilation system, or other air movement system for either air or gas streams, in which the duct section can be mounted directly to a fan or incorporated into a transmission duct. The sound attenuating baffle is typically oriented in the flow direction through the duct, and includes an outer casing containing sound absorbing material therein. An internal mass layer formed of a sound barrier material is suspended within the sound absorbing material which fills the outer casing. The mass layer increases the low frequency sound attenuation of the sound attenuating baffle.

7 Claims, 3 Drawing Sheets

(56) References Cited

U.S. PATENT DOCUMENTS

| | | | | | |
|---|---|---|---|---|---|
| 3,692,140 | A * | 9/1972 | Smith | B64F 1/26 | 181/213 |
| 3,856,439 | A * | 12/1974 | Moehrbach | F04B 39/0038 | 181/204 |
| 3,876,034 | A * | 4/1975 | Antonini | E04B 1/86 | 181/208 |
| 4,266,602 | A * | 5/1981 | White | F28D 7/0058 | 165/124 |
| 4,276,954 | A * | 7/1981 | Romano | E06B 7/084 | 160/236 |
| 4,330,047 | A * | 5/1982 | Ruspa | F24F 13/08 | 181/224 |
| 5,426,268 | A * | 6/1995 | Yazici | F24F 7/08 | 181/224 |
| 5,861,585 | A * | 1/1999 | Van Every | G01M 9/04 | 181/224 |
| 6,035,964 | A * | 3/2000 | Lange | F01D 25/30 | 181/224 |
| 6,260,658 | B1 * | 7/2001 | Darrell | F01D 25/30 | 181/224 |
| 2012/0160603 | A1 * | 6/2012 | Braybrook | E06B 9/386 | 181/294 |
| 2017/0276397 | A1 * | 9/2017 | Mouratidis | F24F 13/24 | |

* cited by examiner

DUCT MOUNTED SOUND ATTENUATING BAFFLE WITH AN INTERNALLY SUSPENDED MASS LAYER

This application claims the benefit under 35 U.S.C. 119(e) of U.S. provisional application Ser. No. 62/299,331, filed Feb. 24, 2016.

FIELD OF THE INVENTION

The present invention relates to a sound attenuating baffle intended to be mounted within the duct of an air distribution HVAC system, a ventilation system, mounted directly to a fan or other air movement system for either air or gas streams in which the baffle is typically oriented in the flow direction through the duct. More particularly the present invention relates to a sound attenuating baffle of the type including an outer casing containing sound absorbing material therein and which is further provided with an internal mass layer formed of a sound barrier material suspended within the sound absorbing material, held in place with the outer casing.

BACKGROUND

Silencers are used in air distribution HVAC systems, ventilation systems and other air movement systems for either air and gas streams. Silencers typically employ rectangular sound absorbing elements such as baffles (otherwise known as splitters), in either a round or rectangular cross-sectional duct or support structure, such as a round or rectangular shaped casing. Silencers may include one baffle or several parallel baffles along the width of the duct or casing. The baffle may be uniform along the length, such as a rectangular silencer, or may be transitional where the inlet cross-section is not equal to the outlet cross-section.

Silencer attenuation may be described as either a transmission loss (TL; dB) or an insertion loss (IL, dB). TL is a measure of the sound power upstream versus the sound power downstream from the silencer air opening(s). IL is a measure of the change in the sound level at a defined point of reception (e.g., outdoors, within a room, etc.) with and without the silencer installed.

For a sound absorbing silencer, the attenuation is primarily achieved using acoustic media fill that provides a dissipation of the sound energy as it travels through the silencer's baffle assembly. The acoustic media fill may include, but not be limited to, fiberglass fiber, rock wool or natural cotton media. The acoustic media is typically protected using a perforated metal liner that is integral to the casing surrounding the acoustic media. The combination of the acoustic media fill and the perforated casing typically encompass the complete baffle assembly, and represents the absorptive silencer state of art.

In order to achieve higher levels of sound attenuation within the low frequency range, baffle lengths tend to increase significantly primarily due to the relatively larger wavelengths of the sound. Silencers with rectangular shaped baffles introduce aerodynamic losses due to the nature of the silencer orientation and installation conditions, resulting in blockage of the cross-sectional area, and aerodynamic friction and dump losses. The net aerodynamic losses are quantified as a total pressure drop or pressure resistance. Lower aerodynamic losses are desirable for most systems, as lower energy would be required to move a given volume or mass of air.

Although it is desirable to achieve higher levels of sound attenuation, simply improving sound attenuation by increasing the length of the baffles is undesirable due to i) the increased friction and aerodynamic losses, ii) added space and installation requirements, as well as iii) additional costs related to manufacturing, handling and installation of larger baffles.

The present invention seeks to improve upon the construction design and installation of baffle type silencers in a unique fashion to improve the attenuation of the silencer.

SUMMARY OF THE INVENTION

According to one aspect of the invention there is provided a sound attenuating baffle device for use in a duct receiving a gaseous flow in a flow direction therethrough, the baffle device comprising:

an outer casing including two opposed faces having i) a length spanning in a longitudinal direction between a leading end and a trailing end of the outer casing, ii) a width spanning in a lateral direction between opposing sides of the outer casing, and iii) a thickness between the two opposed faces which is reduced in dimension relative to the length and the width, the outer casing being adapted to be supported within the duct such that the longitudinal direction is aligned with the flow direction;

sound absorbing material occupying a hollow interior of the outer casing between the two opposed faces;

a layer of sound barrier material supported within the hollow interior of the outer casing so as to be surrounded by the sound absorbing material.

The present invention relates to an improved silencer baffle which incorporates a mass layer therein for increasing the low frequency attenuation of the silencer. The mass layer is typically a sound barrier material which has the ability to reflect or block sound. Sound barrier materials conventionally include dense, typically non-porous materials, for example metal and gypsum board. In the preferred embodiment, the device includes a sheet of metal defining the mass layer within a baffle that is filled with acoustic media. The acoustic media is typically a sound absorbing material having the ability to absorb sound. Sound absorbing materials conventionally include porous, lightweight materials, for example fibrous materials such as fiberglass and mineral wool.

The mass layer is positioned along the length direction of the baffle. Embodiments of the invention can increase the low frequency attenuation produced by a silencer while introducing no additional aerodynamic losses. The mass layer may be held in place within the baffle through the simple compression of the acoustic media fill surrounding the mass layer such that the edge of the sheet of metal avoids direct contact with the baffle's casing or structural supports. Alternatively, the mass layer may be supported by rubber or neoprene isolators between the sheet of metal and the baffle's structural supports, if required due to the space allowed by the baffle design. The mass layer is preferably placed at a maximum distance from both baffle surfaces along the normal direction, as allowed by the space available and configuration of the acoustic media fill.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
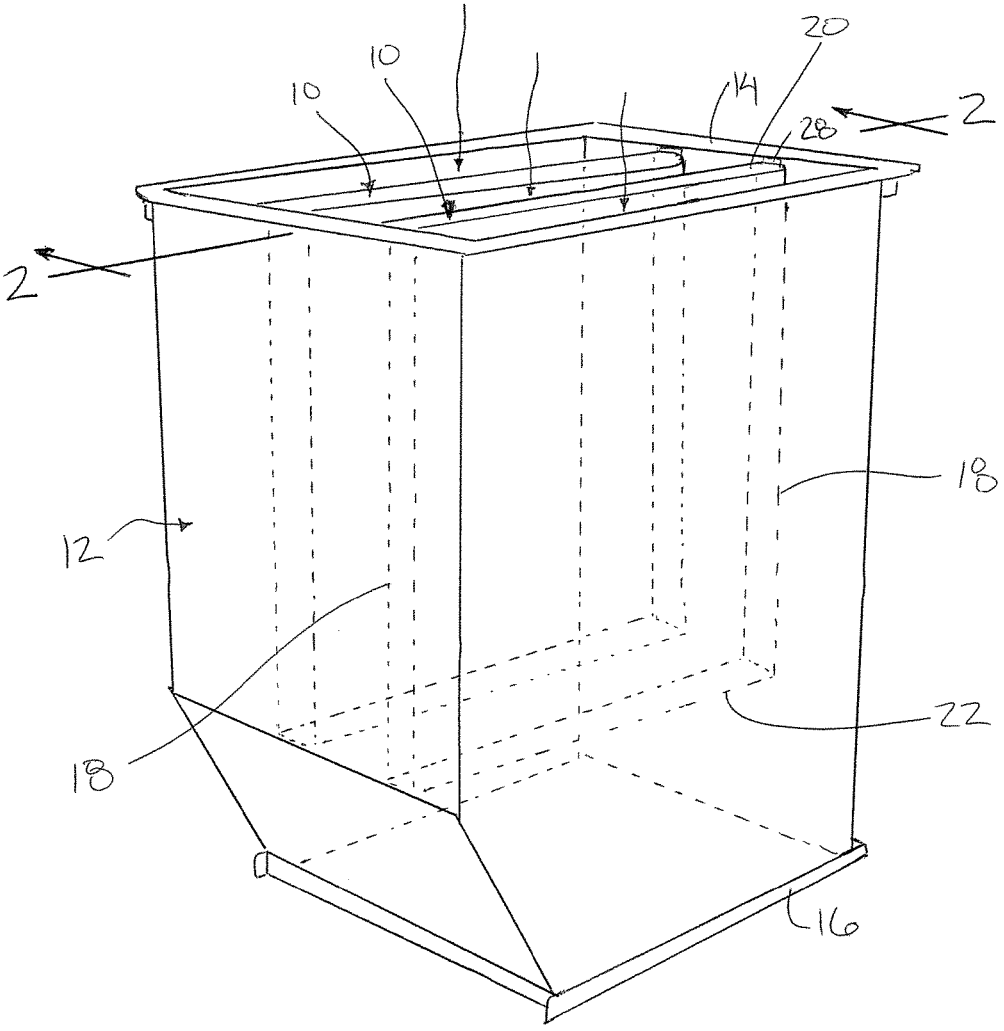
FIG. 1 is a perspective view of an exemplary duct locating a silencer comprising sound attenuating baffles according to the present invention therein.
Figure 2:
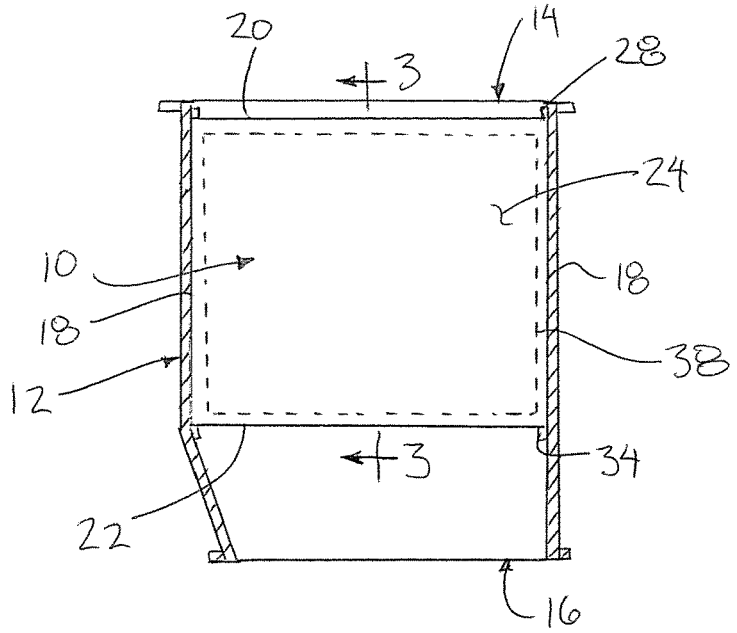
FIG. 2 is a schematic sectional view along the line 2-2 of FIG. 1.
Figure 3:
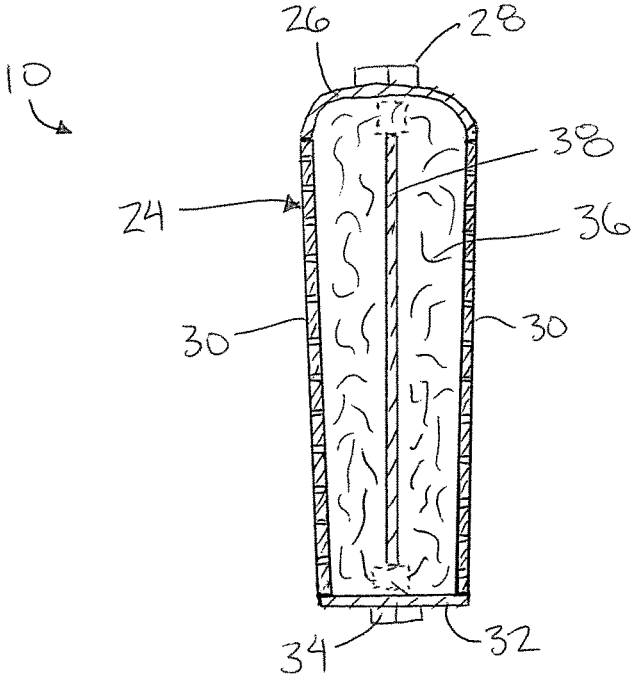
FIG. 3 is a schematic sectional view along the line 3-3 of FIG. 2.
Figure 4:
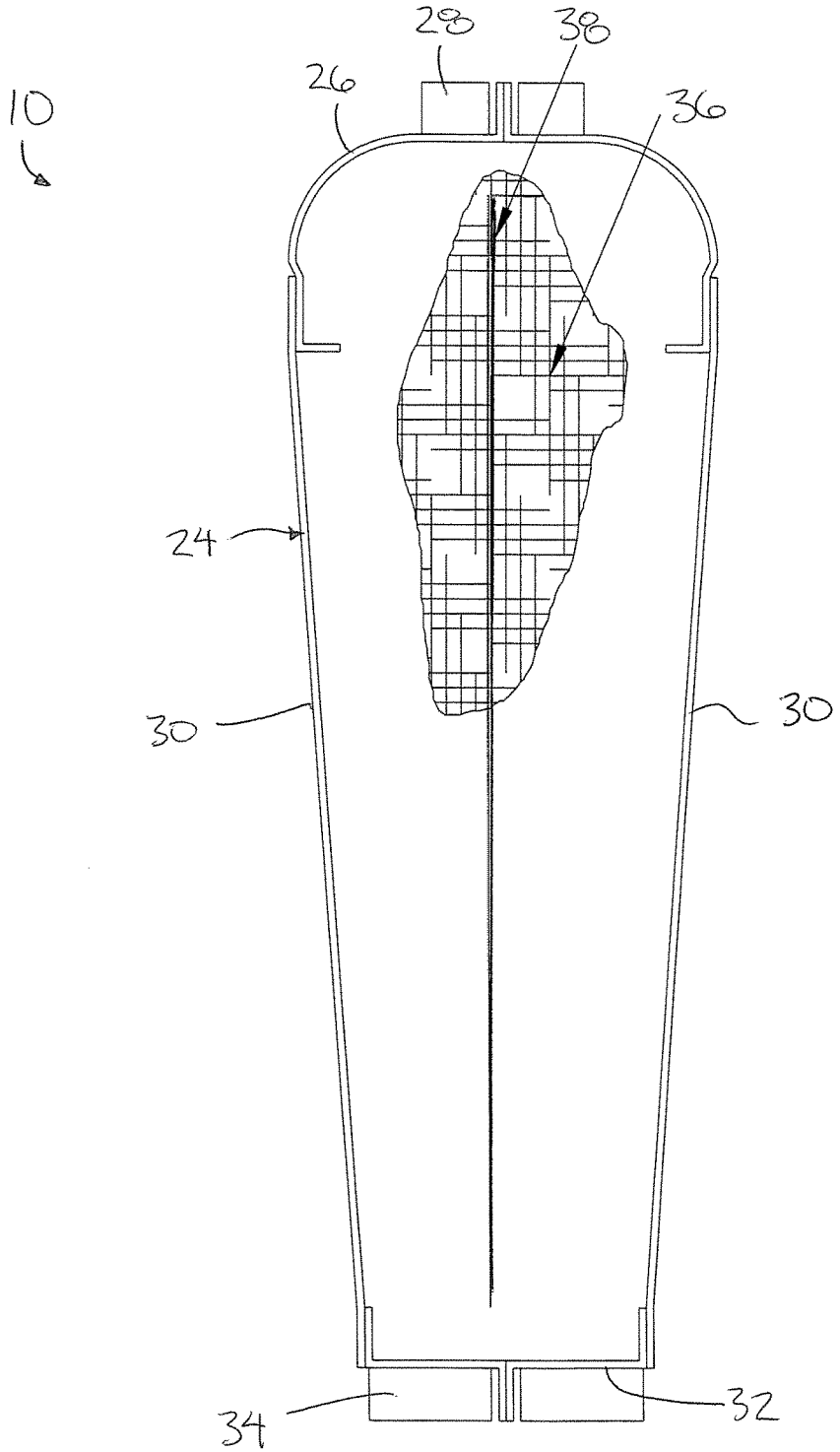
FIG. 4 is a detailed sectional view along the line 3-3 of FIG. 2.

Referring to the accompanying figures there is illustrated a sound attenuating baffle device generally indicated by reference numeral 10. The device 10 is particularly suited for use in a silencer apparatus for attenuating sound in a ducted flow. The duct may be any suitable size or shape for receiving a flow of air or gas therethrough in a flow direction of the duct in air distribution HVAC systems, ventilation systems and other air movement systems for either air and gas streams In the illustrated embodiment, the duct is a transitional duct section 12 having a rectangular cross-section which tapers to be reduced in cross-sectional area from an inlet end 14 to an outlet end 16. In further embodiments however, the sound attenuating baffle device 10 can be readily applied to any other type of duct including a straight duct section, or an elbow duct section while still achieving the benefits described herein. The flow direction through the duct is understood herein to correspond to the direction that air moves through the duct. In a straight or transitional duct, the flow direction is typically linear from the inlet to the outlet end of the duct; however, in an elbow duct, the flow direction is understood to follow a generally curved path from the inlet to the outlet of the duct.

A silencer apparatus is mounted within the duct comprised of one or more baffle devices 10. In the illustrated embodiment, the silencer apparatus mounted within the duct 12 comprises two baffle devices 10 which are mounted parallel and spaced apart from one another within the perimeter boundary of the duct.

Each baffle device 10 extends in a lateral direction across a full width of the duct between two opposing sides 18 of the baffle. Each baffle also extends in a longitudinal direction generally parallel to the flow through the duct from a leading end 20 of the baffle device to a trailing end 22. The baffle device is generally uniform in shape in the lateral direction across the full width. A thickness of the baffle device, measured perpendicularly to both the lateral and longitudinal directions, tapers in the flow direction so as to be reduced in overall thickness from the leading end 20 to the trailing end 22.

Each baffle device includes an outer casing 24 in the form of a shell which defines the outer boundary of the baffle device. The outer casing 24 includes a first cap 26 spanning laterally across the full width of the baffle device at the leading end. The first cap 26 is formed of sheet metal and is generally concave at the outer side in the direction of the thickness of the baffle, while extending generally linearly across the full width of the baffle in the lateral direction with a uniform profile. The first cap 26 is typically formed to be devoid of perforations so as to be generally domed and aerodynamic in shape. In the illustrated embodiment mounting flanges 28 are formed at opposing ends of the first cap 26 for mounting two opposing side walls of the surrounding duct, however in further embodiments various other means may be used to support the baffle device relative to the duct.

The outer casing 24 further comprises two opposed faces 30 comprising perforated metal liner sheets which are generally planar in shape for spanning the full width and substantially the full length of the outer casing. The overall thickness of the baffle is defined by the distance between the two opposed faces 30.

A second cap 32 is mounted between the two opposed faces 30 at the trailing end of the baffle device to span the full width between opposing sides of the duct and to span the full thickness between the opposing faces. The second cap 32 may be planar in shape, oriented perpendicularly to the flow direction through the duct. Mounting flanges 34 are also provided at opposing ends of the second cap 32 for mounting to opposing side walls of the duct according to the illustrated embodiment, however in further embodiments various other means may be used to support the baffle as noted above. The second cap 32 in the illustrated embodiment is a solid panel.

The perforated liner sheets defining the two opposed faces 30 of each baffle device are oriented generally in the flow direction, however, the faces 30 are sloped by a few degrees relative to the flow direction such that the two opposed faces taper towards one another to reduce the overall thickness therebetween in the flow direction from the first cap 26 at the leading end to the second cap 34 at the trailing end.

A hollow interior of the resulting outer casing 24 is filled with a sound absorbing material 36. Sound absorbing materials suitable for use with the present invention include lightweight, porous or loose fill materials such as fibrous material including fiberglass, mineral wool, or natural cotton media for example, which have the ability to dissipate sound energy travelling therethrough.

A layer of sound barrier material 38 in the form of a uniform metal sheet devoid of apertures is mounted within the hollow interior of the outer casing so as to be fully surrounded by the sound absorbing material 36. The sheet forming the sound barrier material spans nearly the full width and nearly the full length in the lateral and longitudinal directions of the baffle device.

In the illustrated embodiment, the layer of sound barrier material 38 is shown as a single, unitary, continuous sheet. In further embodiments however, the layer of sound barrier material 38 may be formed of a plurality of sheets which are connected or supported in proximity with one another relative to the surrounding casing 24 to provide the function of a single, continuous barrier.

Also in the illustrated embodiment, the sheet is shown to be centred between the perforated sheets forming the two opposed faces 30 in the direction of thickness of the baffle device such that the layer of sound barrier material is supported to be equidistant to the two opposed faces and such that a perimeter edge of the layer of sound barrier material is spaced apart from the perforated sheet material forming the outer casing about the full perimeter of the layer of sound barrier material. In further embodiments however, any location of the layer of sound barrier material 38 within the surrounding outer casing 24 which maintains no direct contact between the layer of sound barrier material 38 and the surrounding casing 24 would be effective at achieving some or all of the benefits of the present invention.

In one embodiment, the perimeter edge of the metal sheet 38 is maintained in spaced relation with the outer casing about the full perimeter by the sound absorbing material 36 which is compressed between the metal sheet 38 and the surrounding outer casing.

Alternatively, resilient mounts 40 may be optionally positioned about the perimeter of the metal sheet 38 to mount the metal sheet relative to the surrounding outer casing. The resilient mounts 40 may comprise rubber or neoprene isolators mounted between the metal sheet 38 and the outer casing structural supports.

Since various modifications can be made in my invention as herein above described, it is intended that all matter contained in the accompanying specification shall be interpreted as illustrative only and not in a limiting sense.

The invention claimed is:

1. A sound attenuating baffle device for use in a duct receiving a gaseous flow in a flow direction therethrough, the baffle device comprising:

an outer casing including two opposed faces having i) a length spanning in a longitudinal direction between a leading end and a trailing end of the outer casing, ii) a width spanning in a lateral direction between opposing sides of the outer casing, and iii) a thickness between the two opposed faces which is reduced in dimension relative to the length and the width, the outer casing being adapted to be supported within the duct such that the longitudinal direction is aligned with the flow direction;

a fibrous sound absorbing material occupying a hollow interior of the outer casing between the two opposed faces, the sound absorbing material being arranged to absorb sound by dissipation of sound energy as sound travels through the sound absorbing material; and a mass layer comprising a sheet of metallic material which is dense in relation to the fibrous sound absorbing material;

the mass layer being suspended within the hollow interior of the outer casing so as to span a majority of the width of the outer casing and a majority of the length of the outer casing in spaced apart relationship to both of the opposed faces of the outer casing;

a perimeter edge of the mass layer being suspended to be spaced apart from a material of the outer casing about a full perimeter of the mass layer by the sound absorbing material which fully surrounds the mass layer; and the mass layer being fully suspended relative to the outer casing by the fibrous sound absorbing material which is under compression between the mass layer and the outer casing.

2. The device according to claim 1 wherein the mass layer comprises a uniform, non-porous sheet.

3. The device according to claim 1 wherein the mass layer is supported equidistant to the two opposed faces across the length and the width of the outer casing.

4. The device according to claim 1 wherein the mass layer comprises a sheet of metal.

5. The device according to claim 1 wherein each of the two opposed faces of the outer casing comprises a perforated sheet material.

6. The device according to claim 1 wherein the outer casing is adapted to span a full width of the duct in the lateral direction.

7. The device according to claim 1 in combination with at least one auxiliary baffle identical in configuration to the sound attenuating baffle device in parallel and spaced apart relation to the sound attenuating baffle device.

* * * * *